US005513603A

United States Patent [19]

Ang et al.

[11] Patent Number: 5,513,603

[45] Date of Patent: May 7, 1996

[54] SEAL AND FASTENER ISOLATOR SYSTEM FOR A VALVE COVER

[75] Inventors: Leoncio C. Ang, Bloomfield; Darlene B. Collins, Southfield; Edward A. Luibrand, Clarkston; Randy L. Dickerman, Ypsilanti, all of Mich.

[73] Assignee: Chrysler Corporation, Auburn Hills, Mich.

[21] Appl. No.: 514,286

[22] Filed: Aug. 11, 1995

[51] Int. Cl.[6] ..... F01M 9/10; B65D 53/00

[52] U.S. Cl. ..... 123/90.37; 123/90.38; 123/198 E; 277/180; 277/235 B

[58] Field of Search ..... 123/90.33, 90.37, 123/90.38, 196 M, 195 C, 198 E; 184/6.5, 6.9; 277/180, 235 B

[56] References Cited

U.S. PATENT DOCUMENTS

| | | | |
|---|---|---|---|
| 2,607,331 | 8/1952 | Wefing | 123/90.38 |
| 2,877,756 | 3/1959 | McCauley et al. | 123/90.38 |
| 4,027,644 | 6/1977 | Timour | 123/90.38 |
| 4,867,461 | 9/1989 | Shimmell | 277/180 |
| 5,121,932 | 6/1992 | Goldman et al. | 123/90.37 |
| 5,280,769 | 1/1994 | Yates | 277/235 B |
| 5,285,754 | 2/1994 | Bell | 123/90.38 |
| 5,323,740 | 6/1994 | Daily et al. | 123/90.38 |
| 5,364,109 | 11/1994 | Sihon | 277/180 |
| 5,365,901 | 11/1994 | Kiczek | 123/90.38 |
| 5,375,569 | 12/1994 | Santella | 123/90.38 |

*Primary Examiner*—Weilun Lo
*Attorney, Agent, or Firm*—Kenneth H. MacLean

[57] ABSTRACT

A seal and fastener isolator system for a thermoplastic valve cover that has the seal made of a silicone rubber and is integrally formed with the fastener isolator so as to allow the entire assembly to be manufactured in one molding operation.

10 Claims, 3 Drawing Sheets

SEAL AND FASTENER ISOLATOR SYSTEM FOR A VALVE COVER

TECHNICAL FIELD

This invention concerns valve covers for internal combustion engines and, more particularly, relates to a seal and fastener isolator system which is combined with a valve cover.

BACKGROUND OF THE INVENTION

Valve covers mounted on internal combustion engines used with current automobiles are being made of various types of materials. Some are made from a metallic material such as aluminum, magnesium, or steel while others are made using a thermoset plastic or thermoplastic material. The valve covers made of aluminum and magnesium are manufactured using a die cast process and afterwards coated with a clear coat of paint. Those made of steel are made using a stamping process and, afterwards, are also painted. Some of the stamped steel valve covers are tri-layer formed with a plastic constrained layer for sound dampening purposes.

One problem with the valve covers made of aluminum and magnesium is that they are quite costly to manufacture. Those presently made of steel or a plastic material may not be as costly to manufacture but use gaskets which are not part of the cover and are not reusable. As a result, the gasket which may be a molded silicone, a molded silicone with a metal carrier, or an RTV (room temperature vulcanized) silicone must be discarded from and replaced onto the sealing surface of the cover if the cover is removed for maintenance purposes. The aluminum and magnesium covers use a molded silicone gasket which is applied or pressed into a molded groove and is also discarded if the cover is removed for service. In addition, those valve covers which may use isolated fastener systems for sound dampening purposes require separate rubber bushing to be inserted into the mounting holes of the cover. As should be apparent, separate bushing inserts tend to increase the time needed to assemble the cover.

SUMMARY OF THE INVENTION

The present invention intends to alleviate many of the problems with the presently used valve covers by having a seal and an isolated fastener system form an integrated part of the valve cover. Thus, separate rubber bushing inserts are not required in that the isolators are integrally formed with the seal resulting in a single piece in which the isolator is part of the seal. Another feature of the present invention is that during the molding process used in manufacturing the valve cover, the bushings are molded into the cover and as a result can also be used to hold the compression limiters in place with a slight interference fit which provides frictional retention to aid in shipping and assembly of the valve cover. Thus, the valve cover can arrive at the engine assembly plant ready for installation without requiring additional assembly steps. A still further feature of the present invention is that the seal is made of a silicone rubber while the cover is made of a thermoplastic material. The seal is molded into the cover and it has been found that it does not show evidence of sticking or tearing during disassembly. It has also been found that the sealing capability of the seal is maintained after reassembling the same part. Thus, the seal is reusable, Moreover, if the seal is damaged, it does not have to be scraped off like RTV. Instead, it can be removed cleanly with little effort and the cover can be reused with a pressed-in-place seal and isolation grommets.

Accordingly, one object of the present invention is to provide a new and improved valve cover made of a thermoplastic material and which is molded with an integrated silicone rubber seal and fastener isolation system.

Another object of the present invention is to provide a new and improved seal and fastener isolator for a thermoplastic valve cover that has the seal made of a silicone rubber and integrally formed with a fastener isolator and which allows the entire assembly to be manufactured in one molding operation.

A still further object of the present invention is to provide a new and improved seal for a thermoplastic valve cover that is made of a rubber silicone material which allows the seal to be reusable if the cover should be removed for service.

The above and other objects and advantages are realized in accordance with the present invention by a seal and fastener isolator system for a thermoplastic valve cover which is adapted to be secured to a first peripheral surface provided on a cylinder head of an internal combustion engine for sealing a cavity located therein. The cover is formed with a flange which includes a second peripheral surface adapted to mate with the first peripheral surface. The second peripheral surface has a circular groove formed therein adjacent each of the holes in the flange. Each pair of adjacent circular grooves are interconnected by a channel formed in the second peripheral surface. A seal made of an elastic material such as silicone rubber is located in each of the channels and each of the grooves. The seal has a portion thereof projecting uniformly out of said each of the channels and each of the grooves. In addition, a bushing is located in each of the holes in the flange and is integrally formed with the seal. The bushing is adapted to receive a compression limiter which is preferably made of metal and combined with a threaded fastener. The compression limiter is formed with a contact surface and, when installed in the bushing, extends beyond the second peripheral surface a distance less than the height of the portion of the seal projecting out of each of the channels and the grooves. Moreover, during use, the combination compression limiter and threaded fastener are spaced from the cover with the bushing serving as an isolator. The arrangement is such that when the fastener is threaded through the flange into the cylinder head, it causes the seal to be compressed between the first and second peripheral surfaces until the contact surface of the compression limiter engages the first peripheral surface whereupon the cavity is sealed and the bushing serves to prevent vibratory noise from being transmitted through the fastener from the engine to the valve cover.

BRIEF DESCRIPTION OF THE DRAWINGS

A more complete understanding of the invention can be derived from the following detailed description when taken in conjunction with the drawings in which.

DETAILED DESCRIPTION OF THE INVENTION

Figure 1:
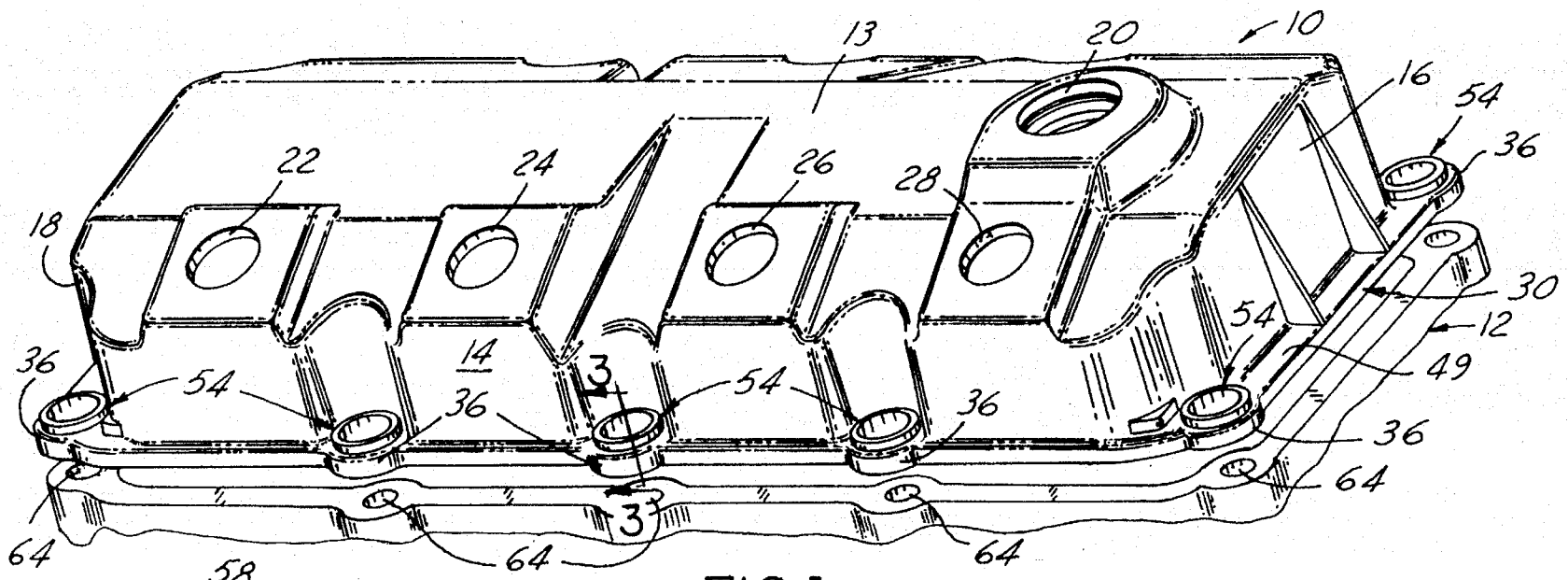
FIG. 1 is a perspective view of a valve cover incorporating a seal and isolator system made in accordance with the present invention and positioned above and spaced from the cylinder head of an internal combustion engine.

Referring to the drawings now and more particularly to FIG. 1 thereof, a valve cover 10 is shown in perspective incorporating a seal and isolator system made in accordance with the present invention. The valve cover 10 is shown positioned above the cylinder head 12 of an four cylinder internal combustion engine and is intended to cover the valve train assembly (not shown) and activating camshaft or camshafts (not shown). In the preferred form, the valve cover 10 is made of a 40% mica/glass reinforced polyethylene terephthalate (PET) thermoplastic which is available from E.I. DuPont, 950 Stephenson Hwy, Troy, Mich. 48007 and identified as Rynite 940-BK505. A thermoplastic of this type has a processing temperature range of 500–550 degrees Fahrenheit.

As seen in FIG. 1, the valve cover 10 includes a top wall 13, a pair of side walls 14 and 15 (one of which is only shown in FIG. 1), and a pair of end walls 16 and 18. The top wall 13 is formed with an oil access opening 20 which is normally closed by a threaded cap (not shown) and also is formed with four holes 22–28 each of which is adapted to have inserted therein a spark plug which is to be sealed in the accommodating hole by a grommet. Sidewalls 14 and 15 as well the end walls 16 and 18 of the valve cover 10 are surrounded by and integrally formed with a flange 30 lower end of which has a flat peripheral surface 32 adapted to mate with and seal a flat peripheral sealing surface 34 provided on the upper end of the cylinder head 12. In addition, the flange 30 is formed with a plurality of identical enlarged bosses 36 spaced strategically along the flange 30. As will be more fully described hereinafter, a threaded fastener is adapted to be received by each of the bosses 36 for securing the valve cover 10 to the cylinder head 12.

As seen in FIGS. 2–6, the peripheral surface 32 on the underside of the flange 30 is formed with a plurality of substantially straight channels 38 the opposite ends of each of which are connected to a circular groove 40 formed in adjacent pairs of the bosses 36. All of the channels 38 and the circular grooves 40 are generally U-shaped in cross section and are of uniform cross-sectional configuration and size. A seal 42, formed as a single piece, is located in each of the channels 38 and each of the circular grooves 40 and has a portion 44 which extends out of the associated channel and associated groove a predetermined distance as seen in FIGS. 3–6. In the preferred form, the seal is made from a fast curing silicone material having a processing temperature range of 245–400 degrees Fahrenheit and a cure time of between 40 and 60 seconds. A silicone material of this type known as Hy-Mold Silicone 1270C is available from Three Bond located at 2000 Town Center, Suite 1480, Southfield, Mich. 48075.

Figure 3:
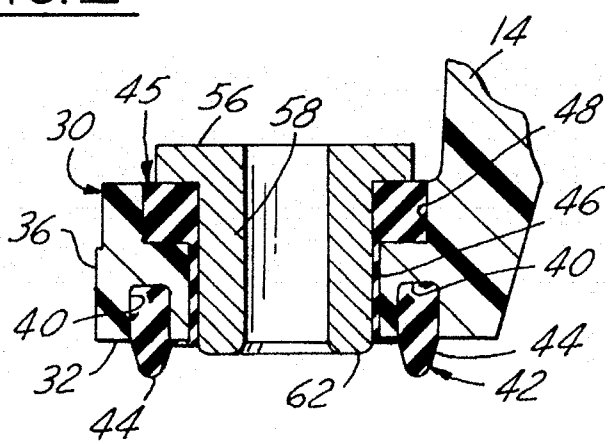
FIG. 3 is an enlarged sectional view taken on line 3—3 of FIG. 1 showing a compression limiter positioned within the isolator bushing which forms a part of the seal.
Figure 4:
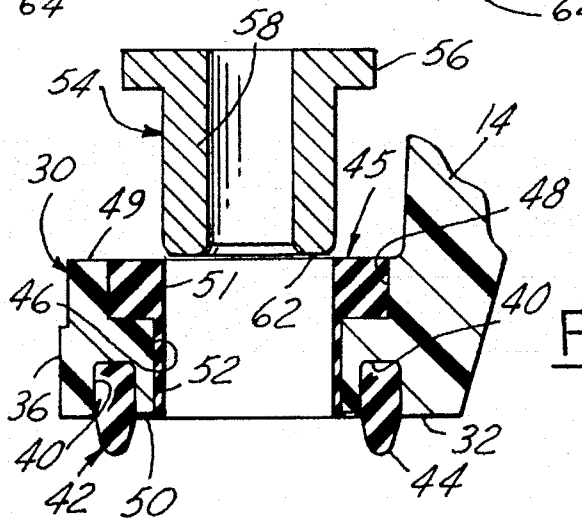
FIG. 4 is a view similar to FIG. 3 but shows the compression limiter positioned above the isolator bushing preparatory to insertion therein.
Figure 2:
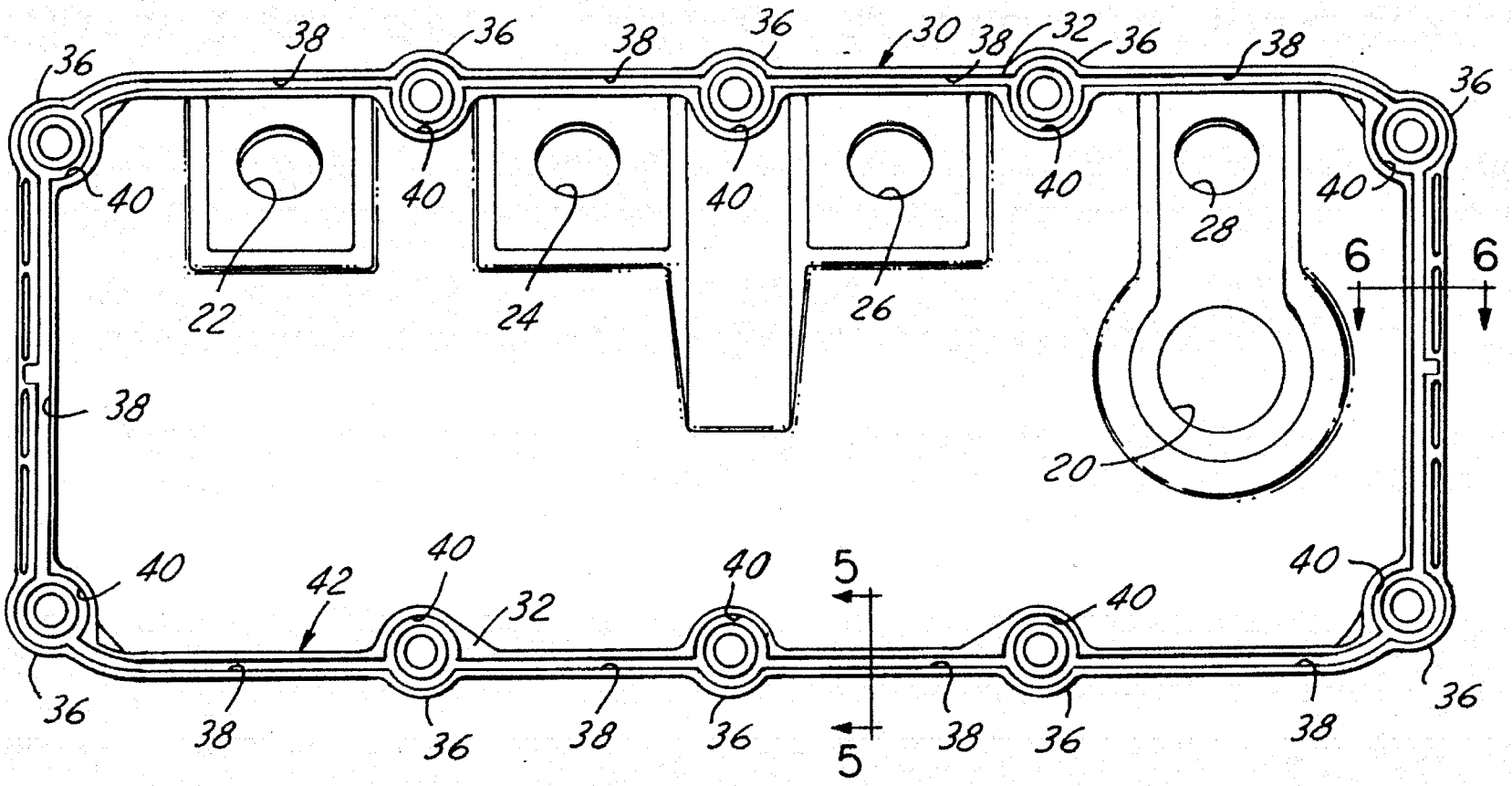
FIG. 2 is a plan view of the underside of the valve cover of FIG. 1 showing in detail the configuration of the seal formed on the lower peripheral surface of the flange formed on the valve cover.
Figure 6:
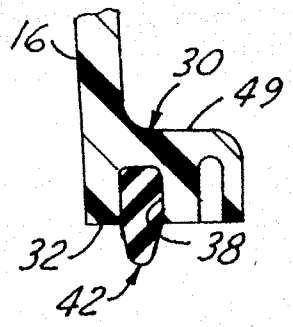
FIG. 6 is a partial sectional view taken on line 6—6 of FIG. 2 showing the seal located in the lower peripheral surface of the flange formed with one of the end walls of the valve cover.
Figure 7:
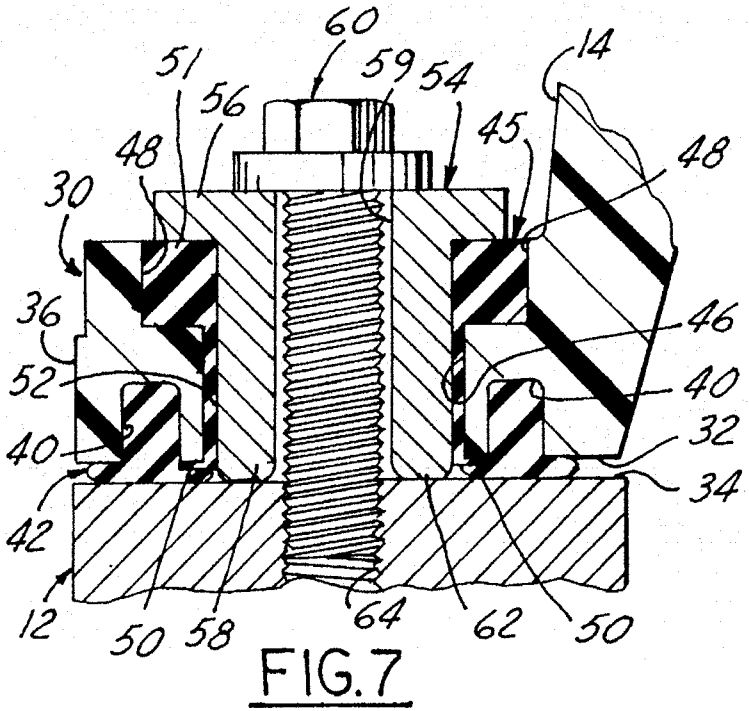
FIG. 7 is a view similar to that seen in FIG. 3 but shows a threaded fastener combined with the compression limiter and serving to secure the valve cover to the peripheral sealing surface formed on the cylinder head of the internal combustion engine seen in FIG. 1.

As best seen in FIG. 3, 4, and 7, each of the bosses 36 is formed with a bushing 45 located in a circular hole 46 which is concentric with the associated circular groove 40. The hole 46 contains a relatively large counterbore 48 at the upper peripheral surface 49 of the flange 30 and a relatively small counterbore 50 located in the lower peripheral surface 32 of flange 30. The counterbore 50 communicates with the associated groove 40 so that during the molding of the seal 42, the lower counterbore 50 allows the seal material to flow into the upper counterbore 48 to form the bushing 45. Thus, both of the counterbores 48 and 50 are filled with the same material used for making the seal 42 and are integrally interconnected by a cylindrical section 52 that is located in the hole 46 and extends between the two counterbores 48 and 50. The portion of the seal material located in the upper counterbore 48 takes the form of a disk 51 which is integral with the cylindrical section 52 and together form the bushing 45 located in the associated hole 46.

As seen in FIG. 1, 3, and 7, the cylindrical opening within the bushing 45 serves to accommodate a compression limiter 54 preferably made from a metal such as steel. The compression limiter 54 is formed with an enlarged head 56 integral with a tubular section 58. As seen in FIG. 7, the cylindrical opening 59 within the compression limiter 54 is sized so as to freely receive the shank of a hex-head screw 60 while the outer diameter of the tubular section 58 is sized so as to provide an interference fit with the cylindrical opening in the bushing 45. Thus, as seen in FIG. 3, when the compression limiter 54 is fully inserted into the bushing 45, it is frictionally held thereby while the lower end of the tubular section 58 of the compression limiter 54 has a contact surface 62 which extends slightly below the plane of the lower peripheral surface 32 on the flange 30 of the valve cover 10.

Accordingly, as seen in FIG. 7, when the valve cover 10 is positioned onto the cylinder head 12 of the engine with the cylindrical opening 59 within each of the compression limiters 54 aligned with the tapped holes 64 in the peripheral sealing surface 34 of the cylinder head 12, each of the compression limiters 54 is provided with a hex-head screw 60 which upon tightening initially caused the seal 42 to be compressed. The compression of the seal 42 continues until the contact surface 62 at the free end of the compression limiter 54 contacts the sealing surface 34 of the cylinder head 12. It will be noted that the outer diameter of the head 56 of the compression limiter 54 is less than the diameter of the upper counterbore 48 formed in the outer portion of the valve cover flange 30. As a result, the bushing 45 acts as an isolator preventing any vibrations generated by the engine from being transmitted from the hex-head screws 60 to the valve cover 10.

Figure 8:
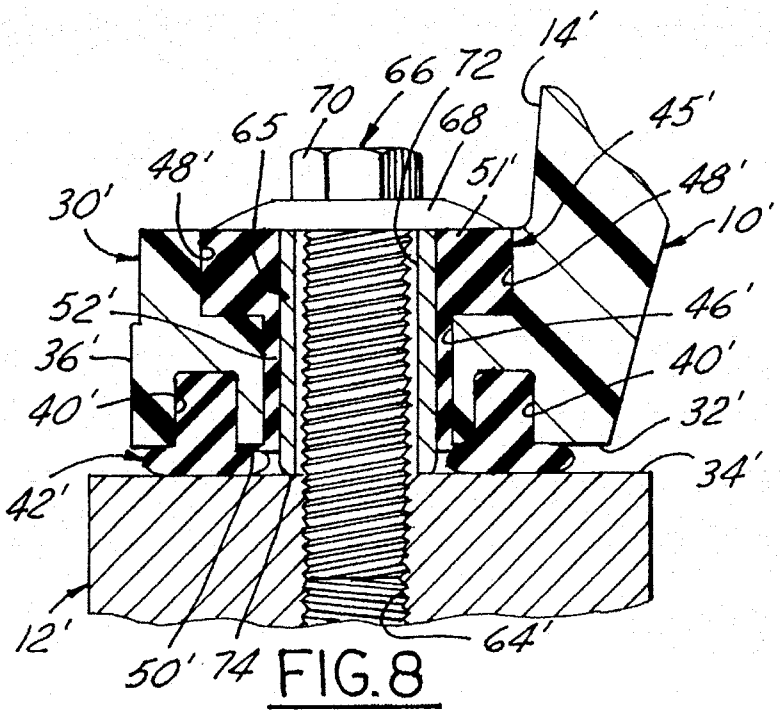
FIG. 8 is a view similar to that seen in FIG. 7 but shows a modified form of the compression limiter and fastener seen in FIG. 7.
Figure 5:
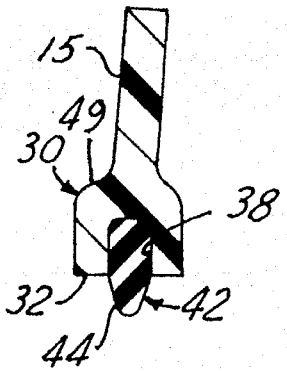
FIG. 5 is a partial sectional view taken on line 5—5 of FIG. 2 showing the seal located in the lower peripheral surface of the flange formed with one of the side walls of the valve cover.

FIG. 8 shows a modified form of the compression limiter 54 seen in FIG. 7. It will be noted that all parts of the valve cover, the seal and the bushing seen in FIG. 8 that correspond to the identical parts seen in FIG. 7 are identified by the same reference numerals but primed. In this instance, the compression limiter 65 takes the form of a tubular sleeve rather than having an enlarged head as provided on the compression limiter 54 of FIGS. 1–7. On the other hand, a cap screw 66 combined with the compression limiter 65 is formed with an enlarged radially outwardly extending cap 68 which is integral with a driver head 70 of the screw. The cap 68 is also integral with a threaded shank which passes freely through a cylindrical opening 72 formed in the compression limiter 65. As with the compression limiter 54 of FIGS. 1–7, the lower end of the compression limiter 65 is formed with a contact surface 74. In addition, as in the case of the compression limiter 54 shown in FIGS. 1–7, the outer diameter of the compression limiter 65 is sized so as to have an interference fit with the cylindrical opening in the bushing 45'. This allows the valve cover 10' to be preassembled with all of the compression limiters 65 inserted in the bushings 45' in the positions shown in FIG. 8 and shipped as a single unit to the engine assembly plant for installation on the cylinder head 12' of an engine.

The modified compression limiter 65 functions in the same manner as the compression limiter 54 of FIGS. 1–7. That is, once the valve cover 10' is correctly positioned onto the cylinder head 12', the cap screw 66 is inserted into the opening 72 within the compression limiter 65 to allow the threads of the threaded shank to engage the threads of the tapped hole 64' in the peripheral sealing surface 34' of the cylinder head 12'. The cap screw 66 is then rotatably driven by an appropriate tool causing the threaded shank to enter the threaded hole 64' of the cylinder head 12'. This causes the seal 42' to be compressed as seen in FIG. 8 until the contact surface 74 of the compression limiter 65 engages the peripheral sealing surface 34' of the cylinder head 12'. As should be apparent, all of the other compression limiters 65 on the valve cover 10' are similarly provided with screws 66 threaded into the cylinder head 12' for securing the valve cover 10' thereto.

One important advantage of the this invention is that the valve cover and the seal can be manufactured in a single two step injection molding operation using a two cavity mold. In this regard, the lower half of the mold will have two identically shaped cavities for forming the valve cover while the upper half of the mold will have two different cavities; one for the valve cover molding and the other for forming the silicone seal. Thus, the thermoplastic polymer will initially be injected into the first valve cover cavity to form the valve cover. The mold is than opened with the valve cover remaining in the first valve cover cavity. The lower half of the mold is then rotated 180 degrees to position the first valve cover cavity containing the molded valve cover in line with the seal forming cavity in the upper half of the mold. At the same time the second valve cover cavity is positioned in line with the valve cover cavity in the upper half of the mold. The mold is then closed again and this time the thermoplastic polymer is injected into the second valve cover cavity while the silicone material is injected into the seal forming cavity to form the seal on the valve cover located in this cavity. Afterwards, the mold is opened and the valve cover-with the integrated seal is removed from the mold. The lower mold half is rotated again and the molding cycle is repeated.

The advantage of the single two step operation is that one molding operation produces a complete valve cover with the silicone seal in place. This simplified process also reduces variability because there is no machining or trimming after molding required. In addition one realizes improved quality and reliability of the valve cover when it is manufactured as described above because the chance of having missing or incorrectly installed gaskets is eliminated.

Once the valve cover is molded as described above, the compression limiter is inserted into each of the bushings and the valve cover is ready for shipment to an assembly plant for installation on the cylinder head of an internal combustion engine. In practice, we have found that a valve cover formed with a seal and fastener isolator in accordance with the present invention can be removed from a engine and reused. Also, tests have shown that the seal, as aforementioned, does not show evidence of sticking or tearing during disassembly and the sealing capability is maintained after reassembly. As alluded to hereinbefore, if the seal is damaged, it does not have to be scrapped off the valve cover. Instead, it can be removed with little effort and the valve cover can be reused with a pressed-in-place seal and isolation grommets for the aftermarket.

Various changes and modifications can be made in the above-described invention without departing from the spirit of the invention. Accordingly, the inventors do not wish to be limited except by the scope of the appended claims.

What is claimed is:

1. A seal and fastener isolator system for a plastic cover adapted to be secured to a first peripheral surface provided on a cylinder head of an internal combustion engine for sealing a cavity located therein, said cover having a flange formed therewith which includes a second peripheral surface adapted to mate with said first peripheral surface, said flange having a plurality of spaced holes formed therein, said second peripheral surface having a circular groove formed therein adjacent each of said holes, each pair of adjacent circular grooves being interconnected by a channel formed in said second peripheral surface, a unitary seal made of an elastic material located in each of said channels and each of said grooves, said seal having a portion thereof projecting uniformly out of said each of said channels and said each of said grooves, a bushing located in each of said holes in said flange and being integrally formed with said seal, a compression limiter adapted to be located in said bushing and be combined with a threaded fastener, said compression limiter having a contact surface which when said compression limiter is installed in said bushing extends beyond said second peripheral surface a distance less than the height of said portion of said seal projecting out of each of said channels and said grooves, the arrangement being such that when said compression limiter is located in said bushing and said threaded fastener is threaded into said cylinder head to secure said valve cover thereto said seal is compressed between said first and second peripheral surfaces until said contact surface of said compression limiter engages said first peripheral surface whereupon said cavity is sealed and said bushing serves to prevent vibratory noise from being transmitted through said fastener from said engine to said cover.

2. The seal and fastener isolator system as set forth in claim 1 Wherein said compression limiter is adapted to be frictionally retained within said bushing.

3. The seal and fastener isolator system as set forth in claim 1 wherein said compression limiter is made of a metallic material.

4. The seal and fastener isolator system as set forth in claim 3 wherein said compression limiter is tubular in configuration.

5. The seal and fastener isolator system as set forth in claim 4 wherein said compression limiter is integrally formed with a head portion which limits its insertion into said bushing.

6. The seal and fastener isolator system as set forth in claim 5 wherein said bushing comprises a disk portion which is integral with a cylindrical section which in turn is integrally with the seal.

7. The seal and fastener isolator system as set forth in claim 6 wherein the outer diameter of said head portion of said compression limiter is less than the outer diameter of said disk portion of said bushing.

8. The seal and fastener isolator system as set forth in claim 7 wherein said seal and bushing is made of a silicone material and said valve cover is made of a thermoplastic material.

9. A seal and fastener isolator system for a plastic valve cover adapted to be secured to a peripheral sealing surface provided on a cylinder head of an internal combustion engine for sealing a cavity formed therein, said valve cover having a flange formed therewith, said flange including a lower peripheral surface and an upper peripheral surface, said lower peripheral surface adapted to mate with said peripheral sealing surface, said flange having a plurality of spaced holes formed therein, each of said holes having a counterbore located in the upper peripheral surface of said flange, each of said holes being surrounded by a circular groove formed in said lower peripheral surface of said flange, each pair of adjacent circular grooves being interconnected by a channel formed in said lower peripheral surface, a unitary seal formed of an elastic material located in each of said channels and each of said grooves, said seal having a portion thereof projecting out of said each of said channels and said each of said grooves, a bushing located in said hole and in said counterbore and having an opening formed therein which is concentric with said hole, said bushing being integrally formed with said seal, a compression limiter adapted to receive a threaded fastener and adapted to be located in said opening of said bushing, said compression limiter comprising a head portion integrally formed with a tubular portion having a free end provided with a contact surface, said head portion of said compression limiter being spaced from said valve cover and located above the section of said bushing positioned in said counterbore and in contact therewith while the contact surface of said tubular portion extends beyond the inner peripheral surface of said flange a distance substantially less than the height of said portion of said seal projecting out of each of said channels and said grooves, the arrangement being such that when said threaded fastener is located in said compression limiter and threaded into said cylinder head it causes said seal to be compressed between said lower peripheral surface of said flange and said peripheral sealing surface of said cylinder head until said contact surface of said bushing contacts said peripheral sealing surface whereupon said cavity is sealed and said bushing serves to prevent vibratory noise from being transmitted from said engine to said valve cover.

10. A seal and fastener isolator system for a thermoplastic valve cover adapted to be secured to a peripheral sealing surface provided on a cylinder head of an internal combustion engine for sealing a fluid-containing cavity formed therein, said valve cover having a flange formed therewith, said flange including a lower peripheral surface and an upper peripheral surface, said lower peripheral surface adapted to mate with said peripheral sealing surface of said cylinder head, said flange having a plurality of spaced holes formed therein, each of said holes having a first counterbore located in the upper peripheral surface and a second counterbore located in the lower peripheral surface of said flange, said second counterbore being surrounded by a circular groove formed in said lower peripheral surface, each pair of adjacent circular grooves being interconnected by a channel formed in said lower peripheral surface, a unitary seal made of silicone located in each of said channels and each of said circular grooves, said seal having a portion thereof projecting uniformly out of said each of said channels and said each of said circular grooves, a bushing comprising a disk portion positioned in said first counterbore and a cylindrical section located in said hole that is integral with said disk portion, said bushing being integrally formed with said seal through said second counterbore, a compression limiter made of metal adapted to receive a threaded fastener and adapted to be located by said bushing, said compression limiter comprising a head portion integrally formed with a tubular portion having a free end formed with a contact surface, said head portion of said compression limiter adapted to be spaced from said valve cover and located above and in contact with the disk portion of said bushing while the contact surface of said tubular portion extends beyond the lower peripheral surface of said flange a distance substantially less than the height of said portion of said seal projecting out of each of said channels and said grooves, the arrangement being such that when said threaded fastener is located in said compression limiter and threaded into said cylinder head it causes said seal to be compressed into engagement with said peripheral sealing surface of said engine until said contact surface of said compression limiter contacts said peripheral sealing surface of said cylinder head whereupon said cavity is sealed and said bushing serves to prevent vibratory noise from being transmitted from said engine to said valve-cover.

* * * * *